US011353034B2

(12) United States Patent
Eck et al.

(10) Patent No.: US 11,353,034 B2
(45) Date of Patent: Jun. 7, 2022

(54) METHOD AND DEVICE FOR DETERMINING AN INDICATOR FOR A PREDICTION OF AN INSTABILITY IN A COMPRESSOR AND USE THEREOF

(71) Applicant: TECHNISCHE UNIVERSITÄT BERLIN, Berlin (DE)

(72) Inventors: Mario Eck, Berlin (DE); Dieter Peitsch, Berlin (DE)

(73) Assignee: TECHNISCHE UNIVERSITÄT BERLIN, Berlin (DE)

( * ) Notice: Subject to any disclaimer, the term of this patent is extended or adjusted under 35 U.S.C. 154(b) by 233 days.

(21) Appl. No.: 16/490,015

(22) PCT Filed: Mar. 1, 2018

(86) PCT No.: PCT/DE2018/100180
§ 371 (c)(1),
(2) Date: Aug. 29, 2019

(87) PCT Pub. No.: WO2018/157889
PCT Pub. Date: Sep. 7, 2018

(65) Prior Publication Data

US 2019/0383297 A1 Dec. 19, 2019

(30) Foreign Application Priority Data

Mar. 2, 2017 (DE) ..... 10 2017 104 414.0

(51) Int. Cl.
*F04D 27/02* (2006.01)
*F04D 27/00* (2006.01)

(52) U.S. Cl.
CPC ..... *F04D 27/0261* (2013.01); *F04D 27/001* (2013.01); *F05D 2270/101* (2013.01)

(58) Field of Classification Search
None
See application file for complete search history.

(56) References Cited

U.S. PATENT DOCUMENTS 5,908,462 A 6/1999 Batson
6,098,010 A * 8/2000 Krener ..... F04D 27/001 105/64.1

(Continued)

FOREIGN PATENT DOCUMENTS

DE 10152026 A1 2/2004
EP 2469098 A1 6/2012
JP H02286899 A 11/1990

OTHER PUBLICATIONS

C. J. Babu, et al., "Detection of Incipient Stall in the Axial Compressor of a Gas Turbine Engine", National Conference on Condition Monitoring, [Online], URL: https://www.researchgate.net/publication/295850838; Oct. 5, 2013; Bangalore.

(Continued)

*Primary Examiner* — Kayla Mccaffrey
(74) *Attorney, Agent, or Firm* — Harness, Dickey & Pierce, P.L.C.

(57) ABSTRACT

The invention relates to a method for determining an indicator for a prediction of an instability in a compressor, which is designed as an axial or radial compressor, having the following steps: operating a compressor designed as an axial or radial compressor in operating states, which differ by different values of a characteristic parameter for a flow mass flux of the compressor, wherein the operating states are run through at decreasing flow mass fluxes; determining the values of the characteristic value for the flow mass flux for the operating states; detecting time-resolved pressure measurement values when running through the operating states by means of a pressure sensor, which is arranged in a housing of the compressor, upstream adjacent to an entrance plane of a rotor stage determining the skew for the operating states and determining an indicator for an instability of the compressor, if an algebraic sign change of the curve rise is determined for a curve profile of the skew over the charac- (Continued)

teristic parameter for the flow mass flux for the operating states. The invention further relates to the use of the method and a device for determining an indicator for a prediction of an instability in an compressor.

12 Claims, 6 Drawing Sheets

(56) References Cited

U.S. PATENT DOCUMENTS

| | | | |
|---|---|---|---|
| 7,108,477 | B2 | 9/2006 | Grauer |
| 2005/0038570 | A1 | 2/2005 | Grauer |
| 2009/0312930 | A1 | 12/2009 | Nakakita et al. |

OTHER PUBLICATIONS

International Search Report (in English and German) of International Search Authority issued in PCT/DE2018/10018, dated Jun. 19, 2018; ISA/EP.

* cited by examiner

METHOD AND DEVICE FOR DETERMINING AN INDICATOR FOR A PREDICTION OF AN INSTABILITY IN A COMPRESSOR AND USE THEREOF

The invention relates to a method and a device for determining an indicator for a prediction of an instability in a compressor and the use thereof.

BACKGROUND

Thermal turbomachines can be designed as axial or radial compressors.

For example, axial compressors represent a central component in aircraft engines. The operating behaviour of the compressor with this or other designs is difficult to predict. The performance data of newly developed compressors are therefore measured on a test bench and then entered in a characteristic map. An important component of the characteristic map is the so-called surge limit. If a surge limit is exceeded, instabilities arise in the compressor, which represent an extremely high aerodynamic load on the compressor and can cause considerable structural damage. To be able to ensure a reliable operation of the given compressor, knowledge regarding the surge limit is of great importance. On the test bench, however, the surge limit can be identified only when it has already been exceeded. For this reason, costly total failures of the tested compressors are accepted in the prior art when determining the surge limit.

A method and a device for predicting the instability of an axial compressor are disclosed in document EP 2 469 098 A1.

A method of representing the surge limit line is disclosed in document U.S. Pat. No. 5,908,462 A.

Document DE 101 52 026 A1 discloses a method for ascertaining a surge limit warning in the case of a turbo compressor or a warning in the event of blade damage.

Document US 2009/0312930 A1 discloses a device for predicting a stall of an axial compressor with a rotor comprising a multiplicity of rotor blades and a cylindrical housing, which covers the outer circumference of the rotor. Furthermore, the device comprises pressure sensors, a unit for calculating key figures for evaluating the stall risk on the basis of time-series data from the pressure sensors and a signal processor for the stall prediction on the basis of the key figures.

SUMMARY

It is the problem of the invention to provide a method and a device for determining an indicator for a prediction of an instability in a compressor designed as an axial or radial compressor, which reliably permit an early warning for the possible occurrence of a compressor instability.

For the solution, a method and a device for determining an indicator for a prediction of an instability in a compressor, which is designed as an axial or radial compressor, are created according to independent claims 1 and 12. Furthermore, the use of the method is provided according to claim 11. Alternative embodiments are the subject-matter of dependent sub-claims.

According to one aspect, a method is created for determining an indicator for a prediction of an instability in a compressor, which is designed as an axial or radial compressor. In the method, a compressor designed as an axial or radial compressor is operated in operating states which differ by different values of a characteristic parameter for a flow mass flux of the compressor, wherein the operating states are hereby run through at decreasing flow mass fluxes. Values of the characteristic parameter for the flow mass flux are determined for the operating states. Time-resolved pressure measurement values are acquired by means of a pressure sensor when the operating states are run through, wherein the pressure sensor is arranged in a housing of the compressor upstream adjacent to an entrance plane of the rotor stage. The skew is determined for the operating states. An indicator of an instability of the compressor (instability indicator) is determined, if an algebraic sign change of the curve rise is determined for a curve profile of the skew over the characteristic parameter for the flow mass flux for the operating states.

According to a further aspect, the use of the method is provided in the determination of an operating limit of a compressor designed as an axial or radial compressor on a test bench or in the monitoring of an engine with a compressor designed as an axial or radial compressor in operation, in particular when used in an aircraft engine or in a turbocharger.

According to a further aspect, a device is created for determining an indicator for a prediction of an instability in a compressor which is designed as an axial or radial compressor. The device comprises a compressor which is designed as an axial or radial compressor. Furthermore, a measuring device is provided, which is set up to determine values of a characteristic parameter for a flow mass flux of the compressor in operating states during the operation of the compressor, wherein the operating states differ by different values of the characteristic parameter for the flow mass flux of the compressor and the operating states are hereby run through at decreasing flow mass fluxes; and to acquire time-resolved pressure measurement values by means of a pressure sensor when the operating states are run through, which pressure sensor is arranged in a housing of the compressor upstream adjacent to an entrance plane of a rotor stage. The device comprises an evaluation unit, which is set up to determine the skew for the operating states and to determine an indicator for an instability of the compressor, if an algebraic sign change of the curve rise is determined for a curve profile of the skew over the characteristic parameter for the flow mass flux for the operating states.

With the aid of the proposed technologies, an indicator can be reliably determined for thermal turbomachines, i.e. axial or radial compressors, which indicator indicates the possible future occurrence of an instability of the compressor. Before the surge limit is reached, measures can be taken to prevent destruction of the compressor when the surge limit is exceeded, whether it is on a test bench for determining an operating limit of the compressor and/or during use and operation of such a compressor, for example in a turbocharger or an aircraft engine.

The compressor is throttled when the different operating states are run through, i.e. operating states are adjusted one after the other, for which the flow mass flux diminishes little by little.

The operation of the compressor during the measurement of the characteristic parameter for the flow mass flux and the pressure measurement values can be undertaken at one and the same speed for the rotor or rotors (rotor stages) of the compressor. Alternatively, provision can be made to use the measurements at different speeds during the determination of the indicator for the instability of the compressor.

The characteristic parameter "skew" is the third statistical moment, for the determination of which the time-resolved pressure measurement values are used. Methods for determining the skew are known as such.

The acquisition of the time-resolved pressure measurement values can be used for measuring the steady pressure.

The pressure sensor can be arranged in the housing of the compressor on an inner wall of the housing. The pressure sensor can be arranged in the housing of the compressor on the inner wall of the housing of the compressor flush with the surface. With this and other embodiments, a plurality of pressure sensors can also be provided, which are arranged in the housing of the compressor upstream adjacent to the entrance plane of the rotor stage, for example circumferentially spaced apart. Provision can be made to use the time-resolved pressure measurement values acquired with the plurality of pressure sensors for the determination of the indicator for the instability of the compressor.

The pressure sensor can be arranged in the housing of the compressor over blade tips of blades of the rotor stage.

During the acquisition of the time-resolved pressure measurement values when the operating states are run through, pressure fluctuations can be acquired in a time-resolved manner by means of the pressure sensor. In this and other embodiments, the scanning of the time-resolved pressure measurement values can take place with a frequency between approximately 20 kHz and approximately 100 kHz, so that in the case where pressure fluctuations are measured in a time-resolved manner, they are determined with a frequency from approximately 10 kHz to approximately 50 kHz.

The algebraic sign change of the curve rise may indicate a local maximum being run through. When the curve of the skew over the characteristic parameter for the flow mass flux runs from greater to smaller values of the characteristic parameter for the flow mass flux, the run-through of the local maximum means that the curve rise switches from negative values to positive values.

A further indicator for the instability of the compressor can be determined, if a further algebraic sign change of the curve rise is determined for the curve profile of the skew over the characteristic parameter for the flow mass flux towards lower flow mass fluxes. The plurality of algebraic sign changes can be determined as separate indicators of differing quality for the possible or expected occurrence of an instability of the compressor, for example regarding a different distance to the surge limit, which can be determined on the basis of the difference in the value of the characteristic parameter for the flow mass flux for the surge limit on the one hand and the value when the algebraic sign change takes place on the other hand.

The algebraic sign change of the curve rise may indicate a local minimum being run through.

The flow coefficient and/or the reduced mass flux for the operating states can be determined as a characteristic parameter for the flow mass flux.

Proceeding from the determination of the indicator and/or the further indicator, a warning signal can be generated as an early warning for compressor instability and can be outputted via an output device. If the indicator and/or the further indicator are determined from the curve profile, a respectively assigned warning signal then optically and/or acoustically indicates to the user that a compressor instability threatens in the event of a further reduction of the flow mass flux.

The compressor can be operated in operating states which lie below a surge limit of the compressor. Provision is made to discontinue the throttling of the compressor and the run-through of the different operating states thus brought about before the surge limit is reached, after which instabilities actually occur. In the testing of the compressor on the test bench, damage to the compressor can thus be avoided, for which reason multiple tests are enabled. If the indicator is specified for a compressor which is in operation or use, for example as an axial compressor in an aircraft engine, possible damage is avoided, as a result of which the useful life can be extended. The indicator and/or the further indicator indicate a possible occurrence of an instability of the compressor before this actually occurs.

The preceding explanations concerning the embodiment of the method apply mutatis mutandis in connection with the device of an indicator for determining an instability of a compressor.

DESCRIPTION OF EXAMPLES OF EMBODIMENT

Further examples of embodiment are explained below, reference being made to the figures of a drawing. In the figures.

Figure 1:
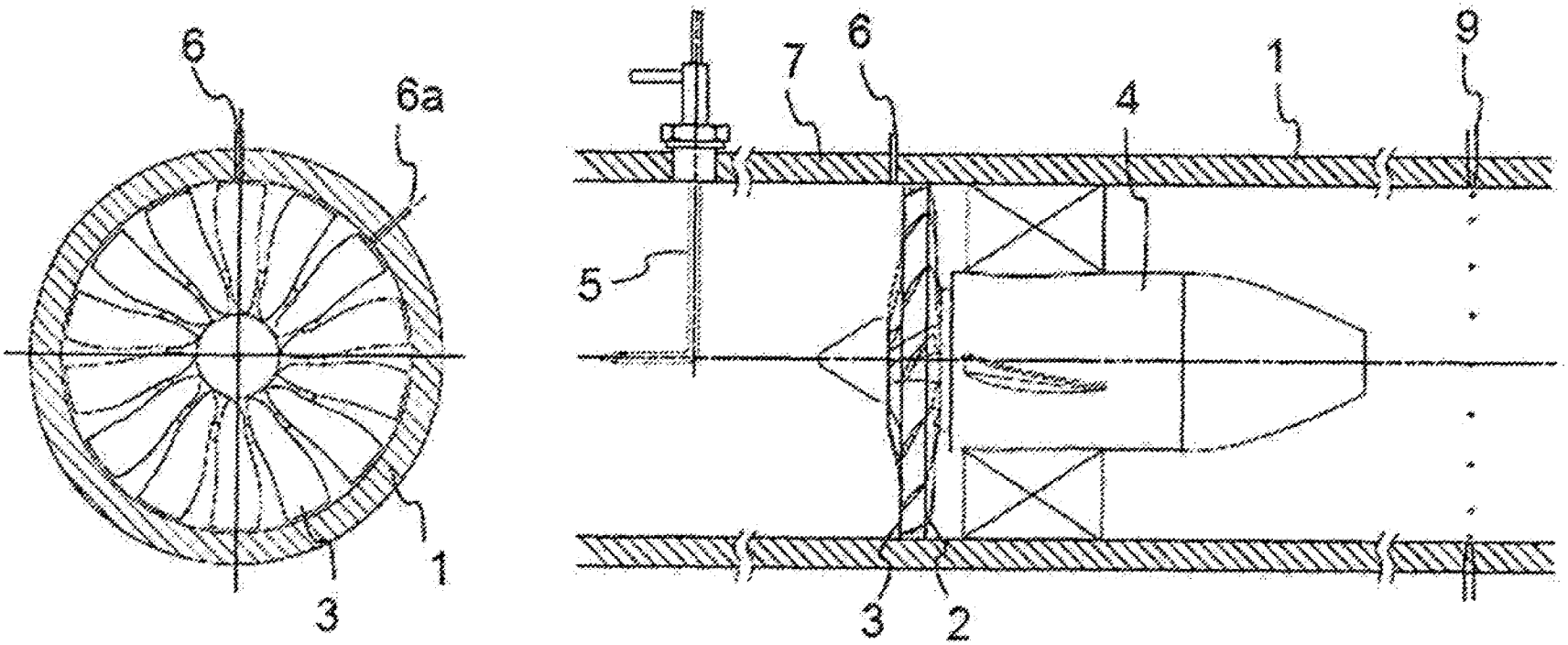
FIG. 1 shows a diagrammatic representation of an arrangement for a test bench for testing an axial compressor.

FIG. 1 shows a diagrammatic representation of an arrangement for a test bench for measuring or determining an axial compressor. A rotor 2 with blades 3 and a drive device 4 for rotating rotor 2 are arranged in a flow tube 1. Stator blades are installed downstream of rotor 2. FIG. 1 moreover shows a front view.

For the measurement of characteristic parameters, a Prandtl tube 5 as well as a pressure sensor 6 are provided, which is arranged on a tube wall 7, in such a way that pressure measurement values can be acquired in a time-resolved manner in respect of an entrance plane of rotor 2 upstream adjacent to the entrance plane on the inner side of tube wall 7. Prandtl tube 5 is used to measure the dynamic pressure in flow tube 1.

Pressure sensor 6 is used to measure the static unsteady pressure. The pressure measurement is carried out time-resolved, wherein for example pressure fluctuations can be measured with a high time resolution in a frequency range from approximately 10 kHz to approximately 50 kHz.

In the embodiment in FIG. 1, a further pressure sensor **6*a* is provided, with which pressure measurements comparable to the measurement with pressure sensor 6** can be acquired in a time-resolved manner and which can alternatively be omitted.

Furthermore, a pressure measurement device 9 is provided in order to measure the static pressure at a compressor exit. In combination with the pressure measurement data from Prandtl tube 5, a pressure ratio generated by the compressor can thus be determined.

Figure 2:
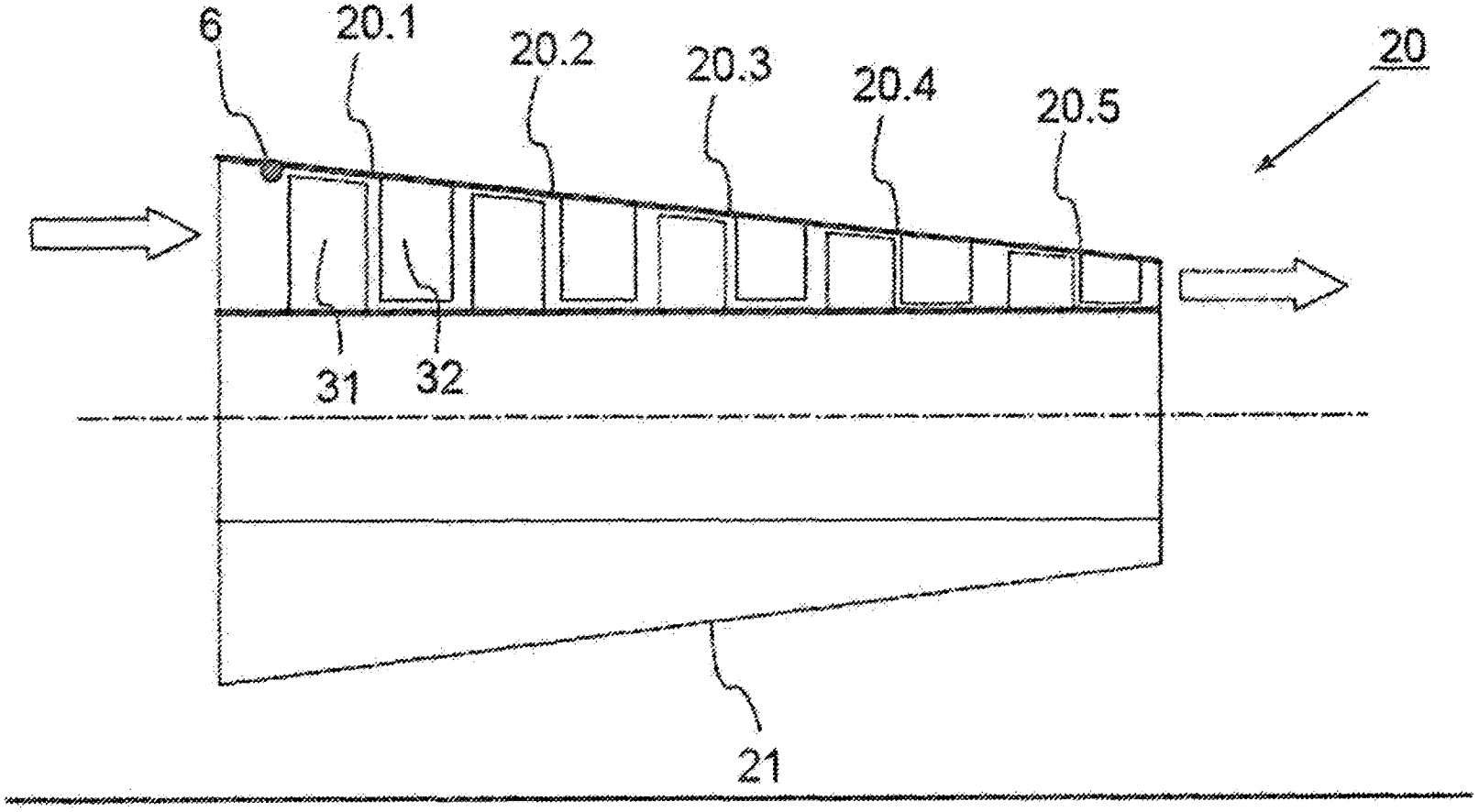
FIG. 2 shows a diagrammatic representation of an axial compressor in cross-section.

FIG. 2 shows a diagrammatic representation of an axial compressor 20, wherein for example a plurality of stage packs 20.1, . . . , 20.5 are arranged behind one another and each comprise a blade rotor and a blade stator, which are arranged in compressor housing 21. Pressure sensor 6 is arranged, comparable to the representation in FIG. 1, adjacent to the entrance plane of the first stage pack 20.1. Alternatively, pressure sensor 6 can also be arranged adjacent to the entrance plane of one of the subsequent stage packs 20.2, . . . , 20.5, in order to acquire the measurement values for the time-resolved pressure measurement.

Figure 3:
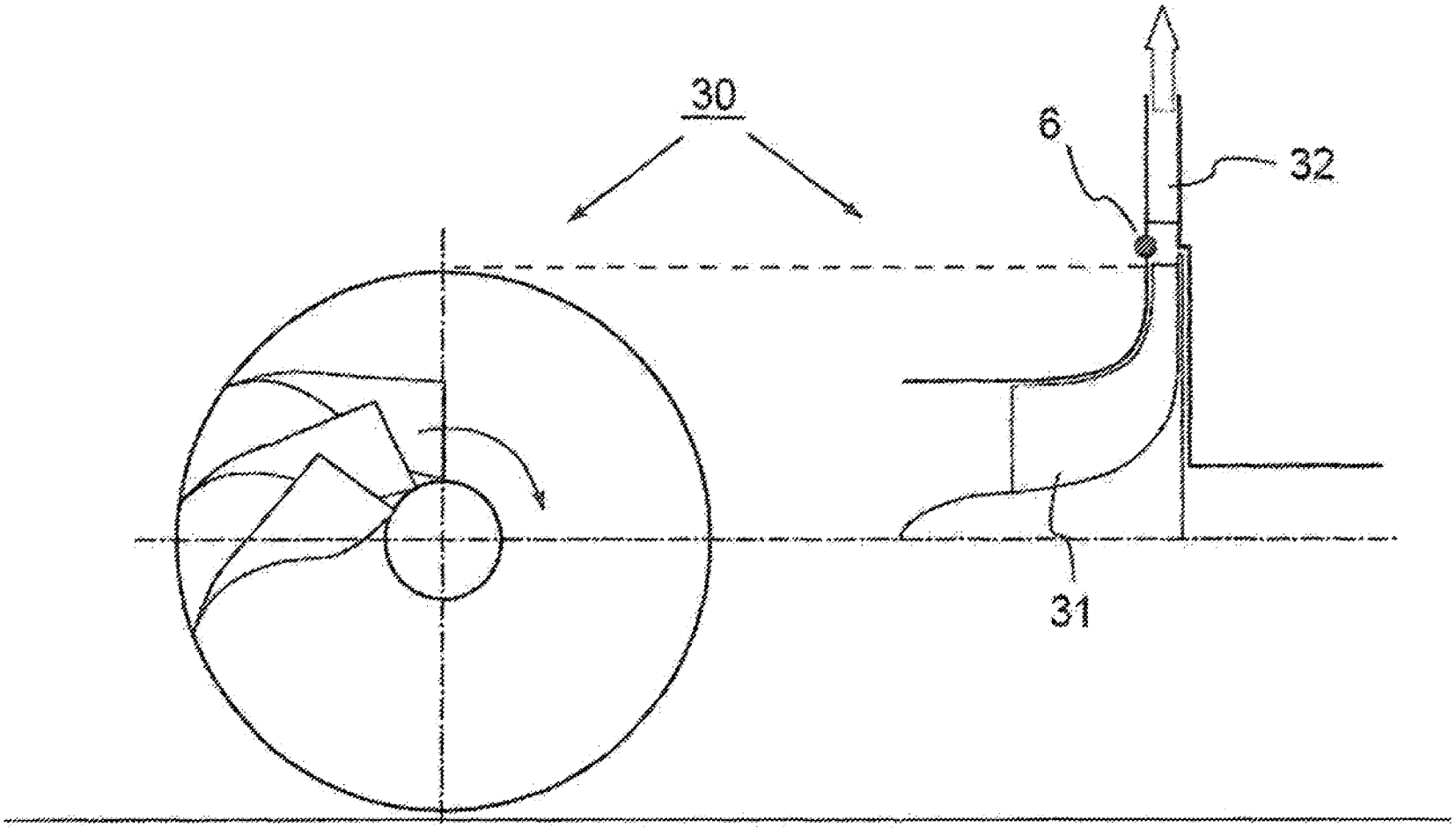
FIG. 3 shows a diagrammatic representation of a radial compressor in cross-section.

FIG. 3 shows a diagrammatic representation of a radial compressor 30 with rotor 31 and stator 32, wherein the pressure sensor is arranged in a comparable position.

With the aid of the arrangement represented in FIG. 1, different operating states can be adjusted for the compressor, for example with the speed of rotor 2 kept constant. In the case of throttling of the compressor when running through the operating states, the latter are characterized by an increasingly smaller flow mass flux. When the operating states are run through, the flow mass flux for the respective operating state and assigned pressure measurement values acquired time-resolved are measured with the aid of pressure sensor 6. The skew (third statistical moment) can be determined as an integral parameter, as it is known as such, from the measurement values for the static unsteady pressure.

The acquired measurement values can be evaluated with the aid of an evaluation device not shown, for example by means of a computer, which comprises a processor and a memory. The evaluation device can be connected to the various elements of the measurement device in order to exchange electronic data and signals. An output for outputting optical and/or acoustic signals, in particular for outputting one or more warning signals, can be connected to the evaluation device.

Figure 4:
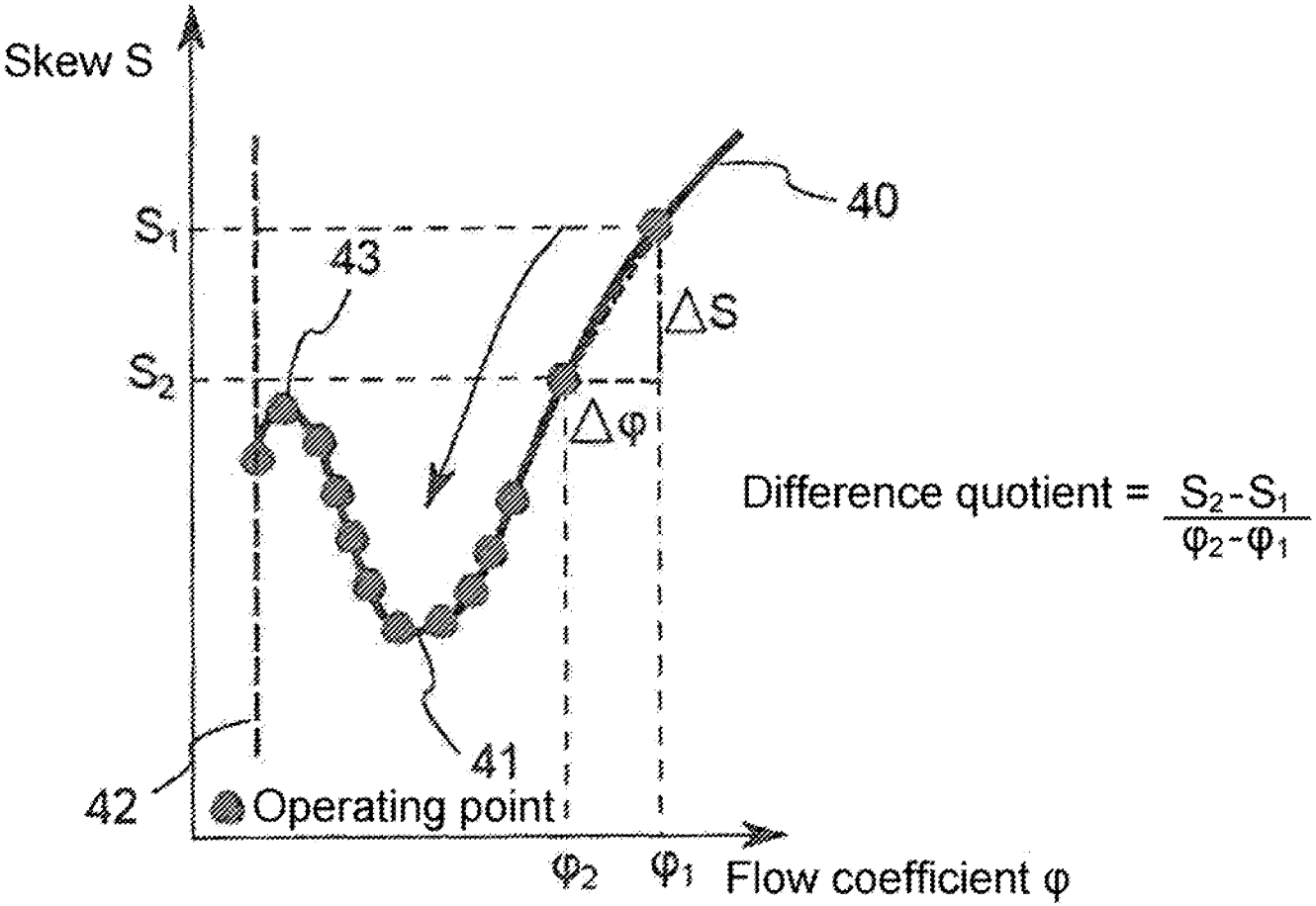
FIG. 4 shows a graphic representation of the curve profile for operating states of a compressor, wherein the skew is plotted over the flow coefficient.

FIG. 4 shows a diagrammatic representation for a curve 40, which results when running through the various operating states with a diminishing flow mass flux, when the skew is plotted over a characteristic parameter for the flow mass flux, wherein flow coefficient $\varphi$ is indicated specifically in FIG. 4.

If the course of the curve 40 is considered from greater flow coefficients to smaller ones, it emerges that a local minimum 41 is first run through before a local maximum 43 is run through, before surge limit 42 is reached. When local extrema 41, 43 are run through, an algebraic sign change for the rise of curve 40 takes place, which can be determined in each case as an indicator of running towards surge limit 42. Local maximum 43 and local minimum 41 each form here indicators of differing quality, because, with respect to flow coefficient $\varphi$, they are at "different distances" from surge limit 42.

Figure 5:
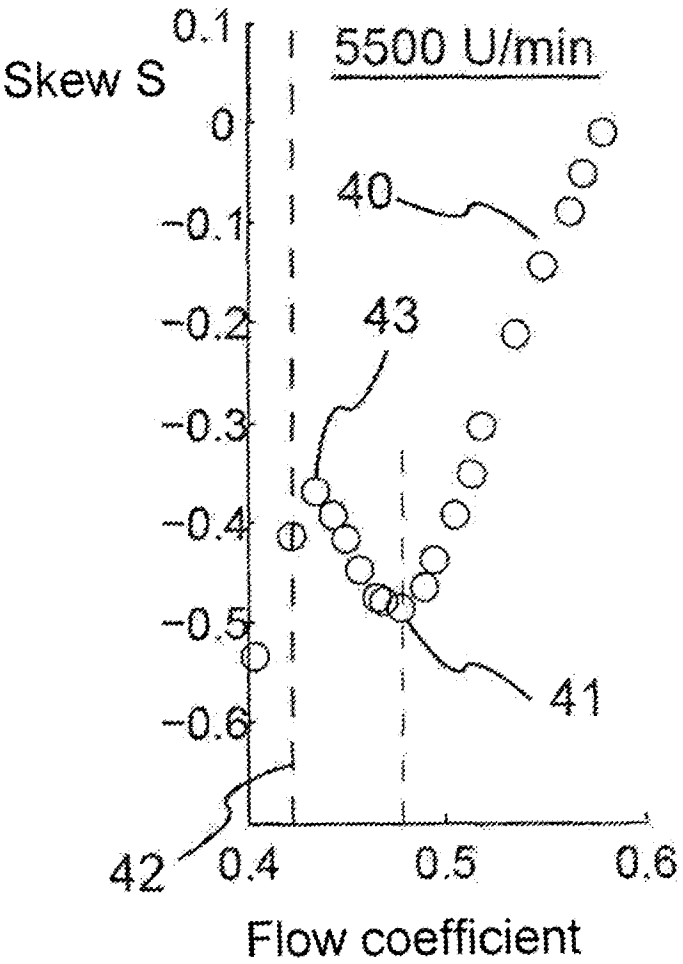
FIG. 5 shows a graphic representation for operating states at a speed of 5500 revolutions per minute, wherein the skew is plotted over the flow coefficient.
Figure 6:
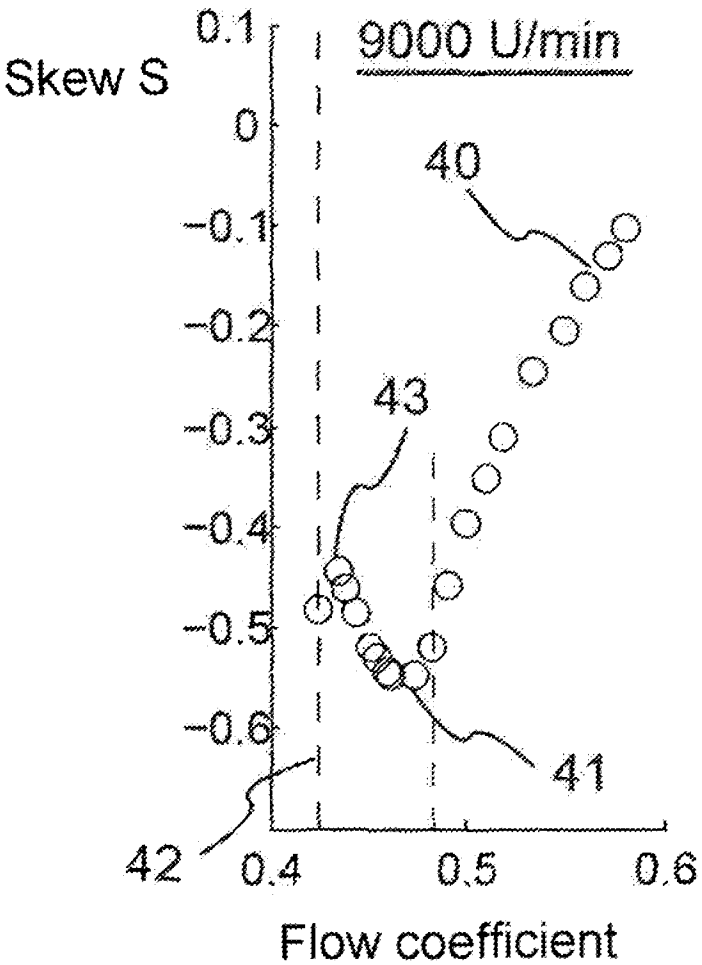
FIG. 6 shows a graphic representation for operating states at a speed of 9000 revolutions per minute, wherein the skew is plotted over the flow coefficient.

FIGS. 5 and 6 show graphic representations for experimental values with speeds of 5500 and 9000 revolutions per minute, wherein the skew is plotted over flow coefficient $\varphi$. The characteristic curve profile can be seen, as was explained for FIG. 4.

Further aspects for the determination of the instability indicator or indicators are explained below.

If the axial compressor is on a test bench (see FIG. 1), all the possible operating points can be approached in a targeted manner. The mass flux which flows through the compressor and the pressure which the compressor builds up are controlled separately by means of a throttle mechanism. It is explained below how the determination of the operating limit of the compressor can be proceeded with.

By means of drive device 4, the compressor is operated at a specified speed. Whereas the speed remains constant, the exit opening of the compressor is successively reduced in size, as a result of which the mass flux diminishes and the built-up pressure increases. The so-called throttling of the compressor can be carried out only until the operating limit is reached. That is to say that, at each speed, there is a maximum possible pressure build-up, after which a collapse of the stable aerodynamics in the interior of the compressor occurs—the compressor enters into so-called "surging".

To construct the curve profile according to FIG. 3, the following parameters are recorded or calculated in the course of the progressive throttling. The characteristic flow parameter plotted on the x-axis represents a similarity parameter for the comparison of different compressor mass fluxes and is ascertained during the test. As an alternative to the characteristic flow parameter, the "reduced mass flux" can also be determined at each operating point. The selection between the two similarity parameters has no effect on the evaluation. For the parameter plotted on the y-axis, a pressure fluctuation is measured with a high time resolution at each operating point on the blade tips. The pressure signal with an arbitrary length can be reduced to an integral parameter, the third statistical moment—the skew. The pair of values, consisting of the flow coefficient (reduced mass flux) and the skew, is transferred to the diagram in FIG. 3. The procedure is repeated for all the following operating points.

The proposed method can use pairs of values for two successive operating points in each case in the various embodiments for the early detection of compressor surging, in order to determine a local curve rise. With the aid of the simple difference quotient, the gradient of the graphic course (rise of the curve) can be determined sequentially between individual operating points. As soon as an algebraic sign change of the difference quotient takes place for the first time during the throttling process (see local minimum 41 in FIG. 3), this result is interpreted as a preliminary stage to the compressor surging. If a further algebraic sign change subsequently takes place (see local maximum 43 in FIG. 3), the last adjusted operating point characterizes the last stable operating point before surge limit 42 is reached. The method provides at this point for the outputting of a corresponding recommendation to discontinue the throttling process in order to prevent the surge limit being exceeded.

The features disclosed in the above description, the claims and the drawing may be of importance both individually as well as in an arbitrary combination for the implementation of the various embodiments.

The invention claimed is:

1. A method for determining an indicator for a prediction of an instability in a compressor, which is designed as an axial or radial compressor, with the following steps:

operation of the compressor designed as an axial or radial compressor in operating states which differ by different values of a characteristic parameter for a flow mass flux of the compressor, wherein the operating states are hereby run through at decreasing flow mass fluxes;

determination of the values of the characteristic parameter for the flow mass flux for the operating states;

acquisition of time-resolved pressure measurement values when the operating states are run through by means of a pressure sensor, which is arranged in a housing of the compressor, upstream, adjacent to an entrance plane of a rotor stage;

determination of the skew for the operating states; and determination of the indicator of an instability of the compressor, if an algebraic sign change of a curve rise is determined for a curve profile of the skew over the characteristic parameter for the flow mass flux for the operating states.

2. The method as claimed in claim 1, wherein the pressure sensor is arranged in the housing of the compressor on an inner wall of the housing.

3. The method as claimed in claim 1, wherein the pressure sensor is arranged in the housing of the compressor over blade tips of blades of the rotor stage.

4. The method as claimed in claim 1, wherein during the acquisition of the time-resolved pressure measurement values when the operating states are run through, pressure fluctuations are acquired in a time-resolved manner by means of the pressure sensor.

5. The method as claimed in claim 1, wherein the algebraic sign change of the curve rise indicates a local maximum being run through.

6. The method as claimed in claim 1, wherein a further indicator for the instability of the compressor is determined, if a further algebraic sign change of the curve rise is determined for the curve profile of the skew over the characteristic parameter for the flow mass flux towards lower flow mass fluxes.

7. The method as claimed in claim 6, wherein the algebraic sign change of the curve rise indicates a local minimum being run through.

8. The method as claimed in claim 1, wherein at least one of the flow coefficient or the reduced mass flux for the operating states are determined as the characteristic parameter for the flow mass flux.

9. The method as claimed in claim 1, wherein proceeding from the determination of the indicator, a warning signal is generated as an early warning for compressor instability and is outputted via an output device.

10. The method as claimed in claim 1, wherein the compressor is operated in operating states which lie below a surge limit of the compressor.

11. The use of a method as claimed in claim 1 in the:

determination of an operating limit of the compressor designed as an axial or radial compressor on a test bench or monitoring of an engine with the compressor designed as an axial or radial compressor in operation.

12. A device for determining an indicator for a prediction of an instability in a compressor, which is designed as an axial or radial compressor, with:

the compressor which is designed as an axial or radial compressor;

a measuring device, which is set up, to determine values of a characteristic parameter for a flow mass flux of the compressor in operating states during the operation of the compressor, wherein the operating states differ by different values of the characteristic parameter for the flow mass flux of the compressor and the operating states are hereby run through at decreasing flow mass fluxes, and to acquire time-resolved pressure measurement values by means of a pressure sensor when the operating states are run through, which pressure sensor is arranged in a housing of the compressor, upstream, adjacent to an entrance plane of a rotor stage, and an evaluation unit configured to determine the skew for the operating states; and to determine an indicator for an instability of the compressor, in response to an algebraic sign change of a curve rise being determined for a curve profile of the skew over the characteristic parameter for the flow mass flux for the operating states.

* * * * *